United States Patent [19]

Marschak

[11] 4,155,459

[45] May 22, 1979

[54] DISPLAY UNIT

[75] Inventor: Howard J. Marschak, Chicago, Ill.

[73] Assignee: Stor-Rite Metal Products, Inc., Chicago, Ill.

[21] Appl. No.: 841,928

[22] Filed: Oct. 13, 1977

[51] Int. Cl.[2] ..... A47F 7/00

[52] U.S. Cl. ..... 211/49 R; 211/60 T; 211/94; 248/220.4

[58] Field of Search ..... 211/49 D, 49 R, 94, 211/94.5, 126, 60 T, 162, 88; 248/220.4, 220.3, 221.1, 222.2

[56] References Cited

U.S. PATENT DOCUMENTS

| | | | |
|---|---|---|---|
| 2,766,958 | 10/1956 | Levy | 248/220.4 |
| 2,879,899 | 3/1959 | Shenkin | 248/220.4 X |
| 3,097,746 | 7/1963 | Handler et al. | 211/126 |
| 3,424,421 | 1/1969 | Kalbow et al. | 248/220.4 X |
| 3,428,187 | 2/1969 | Baggott | 211/126 X |
| 3,501,015 | 3/1970 | Behles | 211/49 R |
| 4,026,508 | 5/1977 | Ziegler | 248/220.3 |
| 4,064,991 | 12/1977 | Swanson | 248/220.4 X |
| 4,113,109 | 9/1978 | Donnelli et al. | 211/49 R |

FOREIGN PATENT DOCUMENTS

| | | | |
|---|---|---|---|
| 2232398 | 1/1974 | Fed. Rep. of Germany | 211/49 D |

*Primary Examiner*—Roy D. Frazier
*Assistant Examiner*—Robert W. Gibson, Jr.
*Attorney, Agent, or Firm*—Vogel, Dithmar, Stotland, Stratman & Levy

[57] ABSTRACT

A display unit used with an aperture board for displaying a plurality of cylindrical objects in which four fixtures each having engagement prongs which space the fixture from the associated apertured board are used to mount spaced apart container sections. Each container section has two horizontal pairs of spaced apart channels which are tapered, thereby permitting sliding engagement of the container section with the fixture. The constructed display unit slopes downwardly at an angle of about 10° to about 12° from a line extending normal to the apertured board providing gravity feed of the displayed merchandise.

10 Claims, 6 Drawing Figures

FIG. 1
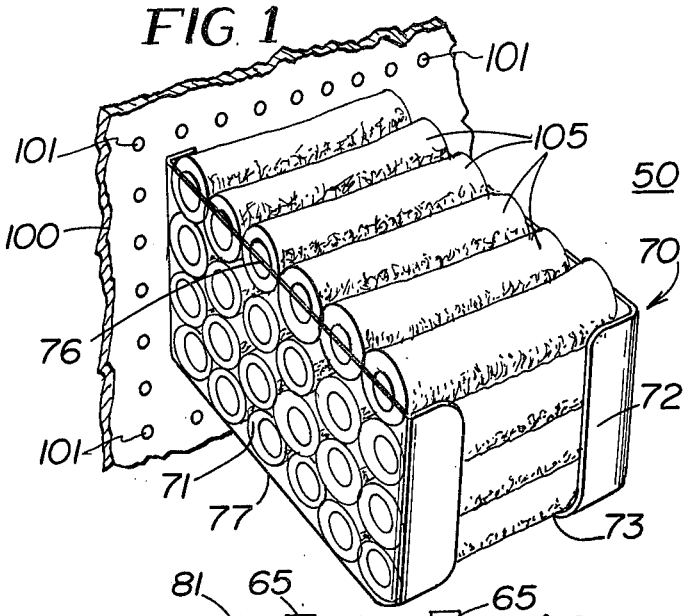
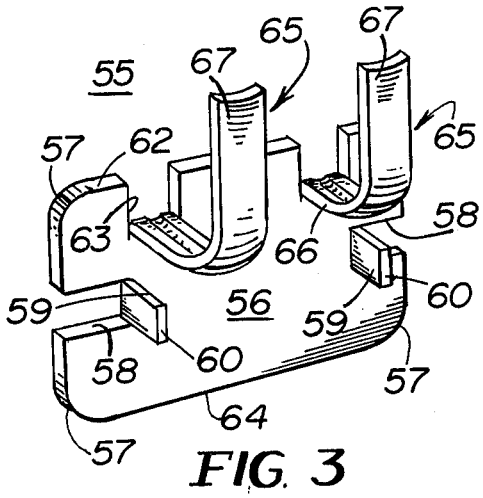
FIG. 3
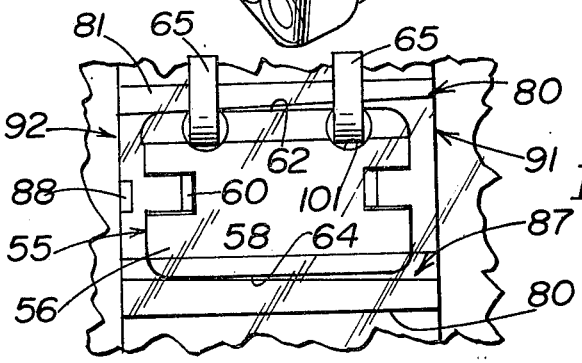
FIG. 4
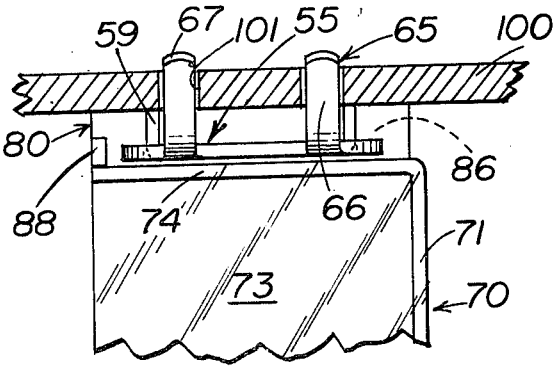
FIG. 5
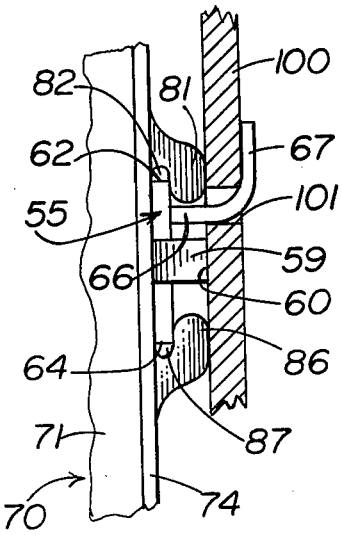
FIG. 6

DISPLAY UNIT

BACKGROUND OF THE INVENTION

Display units used to display and illustrate merchandise must be inexpensive yet of relatively sturdy construction in order that a great many of the display units can be used while at the same time withstanding severe abuse so that the displayed commodities are retained in a predetermined spaced display relationship. An additional requirement for display units is that they have a capacity sufficiently large to permit sufficient numbers of the units to be shown at one time so that the store management does not continually have to replenish the supply of its displayed articles. Stocking and restocking problems are alleviated by having a large capacity display unit. On the other hand, when the display units becomes too large, often they become subject to unwanted flex and/or sway problems thereby resulting in accidental tipping or tilting which is undesirable.

Prior art display units which are available generally have one or more of the above mentioned problems, that is a capacity which is small so that frequent restocking is required or alternatively a larger capacity, but a flimsy construction so that the displayed merchandise is often bumped or jostled from the display. The subject invention obviates all of the foregoing problems, and in addition, provides an automatic feed of the displayed units to the front of the display when the customers remove units for purchase.

BRIEF SUMMARY OF THE INVENTION

This invention relates to a display unit in which a pair of container sections are rigidly mounted to an associated apertured board to provide a display for cylindrical objects, and more particularly, this invention pertains to a unique combination of container sections and fixtures which result in rigid construction with a sufficiently large capacity to prevent frequent restocking.

A principal object of the present invention is to provide a display unit used with a apertured board support for displaying a plurality of elongated objects, comprising a plurality of fixtures each having engagement prongs which in use extend through apertures in the apertured board to mount the fixture thereto, a spacer extending outwardly from said fixture for maintaining said fixture a predetermined distance from the apertured board surface, a pair of container sections with each section being mountable on at least one fixture, mounting means on the rear of each container section forming opposed channels for engaging each associated fixture to mount said container section to the apertured board, said container sections when mounted on said fixtures and hence to the apertured board combining to form side end and bottom walls for retaining and displaying a plurality of elongated objects.

Another object of the present invention is to provide the display unit of the type set forth wherein each of the engagement prongs and spacer prongs extend away from the fixture body at junctures spaced inwardly of the adjacent edge to permit sliding engagement of the mounting means on the container sections and the fixtures.

A further object of the present invention is to provide a display unit of the type set forth wherein the mounting means on each container section comprises a plurality of channels wherein each channel is tapered such that the channel at one end thereof is wider than the vertical extent of the associated fixture body and at the other end thereof is narrower than the associated fixture body to permit frictional engagement of each channel and the associated fixture to provide a rigid mounting of the container sections and fixtures to the apertured board.

These and other objects of the present invention may more readily be understood when taken in conjunction with the following specification and drawings, in which:

BRIEF DESCRIPTION OF THE DRAWINGS

FIG. 1 is a perspective view of the display unit of the present invention shown mounted to an associated apertured board and having a plurality of cylindrical units stored therein;

FIG. 3 is an enlarged perspective view of a fixture of the present invention;

FIG. 4 is a rear elevational view showing a fixture mounted to the apertured board with a container section slidably engaged thereon;

FIG. 5 is a top plan view of a fixture and container section mounted to a apertured board; and FIG. 6 is a side elevational view partly in section of a fixture and container section mounted to an associated apertured board.

DESCRIPTION OF THE PREFERRED EMBODIMENT

Figure 2:
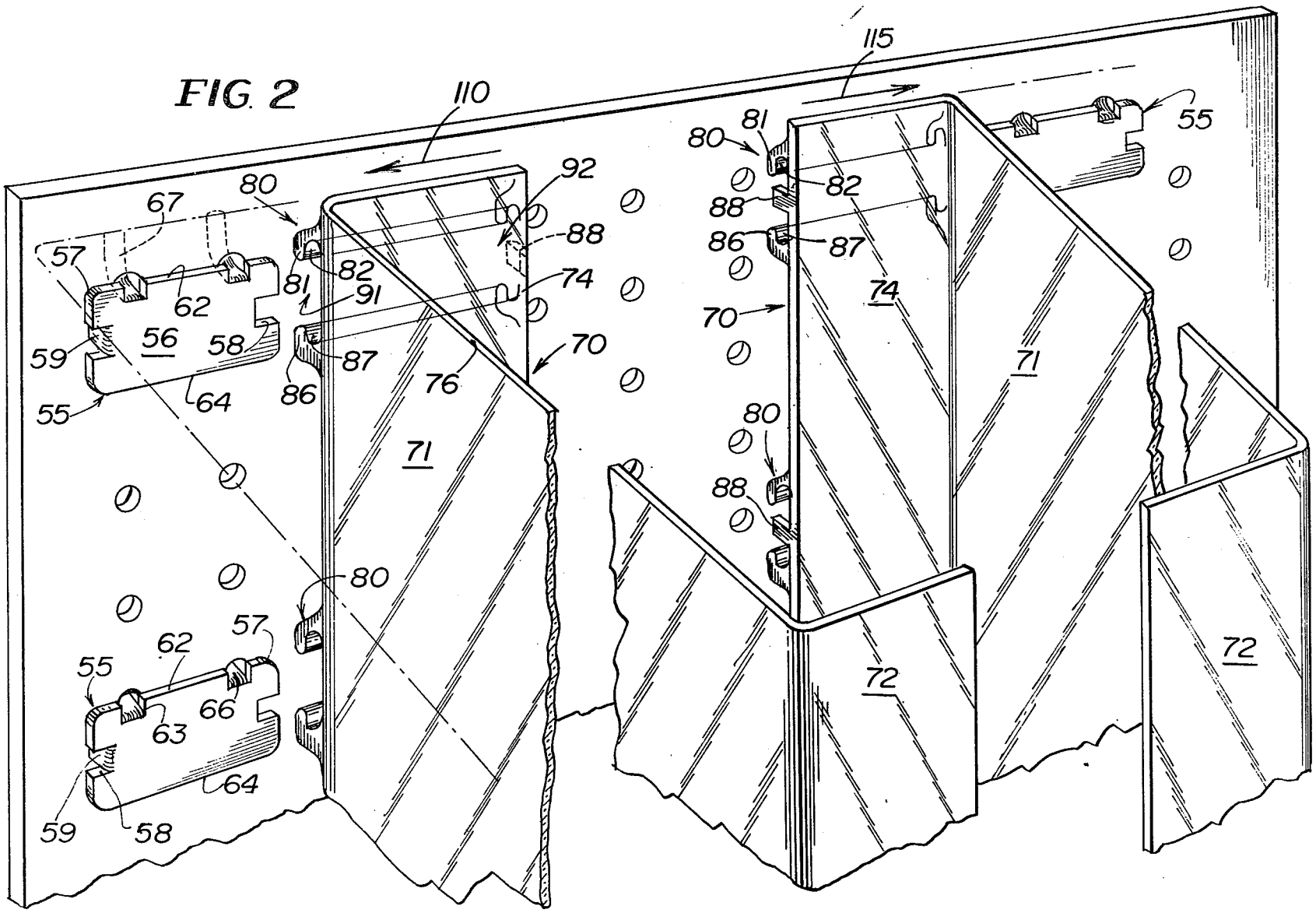
FIG. 2 is an exploded perspective view of a portion of the display unit illustrated in FIG. 1, showing the positions of the container sections and the fixtures prior to sliding engagement therebetween.

Referring now to the drawings, there is shown a display unit 50 which includes, as best seen in FIG. 3, a plurality of fixtures 55 each fixture having a flat planar body 56 having rounded corners 57 and two inwardly extending slots 58, one at each end of the fixture body. The material from the slots 58 is bent inwardly to form two spacer prongs 59, each having an abutment end surface 60, each prong 59 extending at an angle substantially normal to the flat spacer body 56.

The spacer 55 has a top edge 62 and a bottom edge 64, the top edge having two spaced apart notches 63 therein. Connected to the horizontal edge at the bottom of each notch 63 is an engagement prong 65 having a horizontal reach 66 and a vertical reach 67. The longitudinal extent of the horizontal reach 66 of each engagement prong is slightly greater than the longitudinal extent of the spacer prongs 59. The fixtures 55 may be made out of any suitable material whether metal or plastic so long as it has sufficient strength and will slide with respect to the material used for the rest of the display unit, as will be described.

The display unit 50 further comprises two container sections 70, each container section having a flat side wall 71 with an inturned distal end or front flange 72, a bottom flange 73 and a mounting or rear flange 74. Preferably, the container section is a single integral piece of molded plastic which is transparent with each of the flanges 72, 73 and 74 extending inwardly from the flat side wall 71 the same extent. The side walls 71 each have a top edge 76 and a bottom edge 77 which are parallel and extend forwardly from the rear flange or panel 74 and downwardly in use at an angle of about 10° to about 12°. In use, the rear flange or panel 74 is vertical and the front flange or panel 72 is parallel to the rear flange 74, but may be angularly disposed about 10° to 12° therefrom. Therefore, the juncture of the top edge 76 with the front panel or flange 72 is closer to the rear flange or panel 74 then is the juncture of the front panel or flange and the bottom panel or flange 73. The construction of each container section 70 is important to position the displayed merchandise correctly and to feed new merchandise to the front of the display unit 50.

On the rear surface of the mounting or rear flanges 74 for each of the container sections 70, are spaced apart mounting channels 80 with one mounting channel being positioned adjacent the top of the container section and the other mounting channel being positioned adjacent the bottom of the container section. Each of the mounting channels is comprised of a horizontally extending upper lip 81 defining an upper channel 82 and a horizontally extending lower lip 86 defining a lower channel 87, the upper and lower lips being spaced apart as hereinafter described. A tab stop 88 is provided on the inner end of each container section between the upper and lower lips 81 and 86, as best seen in FIG. 2.

Each of the mounting channels 80 is tapered from the outside of the respective container section 70 toward the inside of the respective container section, that is each of the channels 80 has a larger vertical extent at the end 91 thereof than at the end 92 thereof, the grooves formed by the lips 81 and 86 tapering from the large end 91 to a smaller end 92 in order to provide frictional engagement with the associated fixture 55 to fixedly mount the container section 70 to the fixture and hence to the apertured board 100. Finally, the entire display unit 50 comprising the multiple fixtures 55 and container sections 70 is mounted on a standard apertured board 100 having a plurality of uniformly spaced rows and columns of apertures 101. Merchandise such as paint rollers 105 are positioned between the container sections 70 and due to the downward slanting nature of the container sections, the merchandise 105 is continuously fed toward the end flanges 72 in order to provide easy access by the purchaser.

In order to construct the display unit 50 comprising the present invention, it is simply necessary to insert four fixtures 55 into an associated apertured board 100 in the usual manner with the horizontal spacing of the fixtures set to accommodate merchandise 105 of the desired length. Thereafter, the lefthand container section 70 as illustrated in FIG. 2, is positioned to the right of the fixtures 55 with the large ends 91 of the associated mounting channels 80 in registry with the associated fixtures 55. Thereafter, the container section 70 is moved to the left as illustrated by the arrow 110 thereby sliding the associated mounting channel 80 over the associated fixtures 55 and specifically the top edge 62 of each fixture 55 fits within the upper groove 82 and the bottom edge 64 of each fixture fits within the bottom channel 87 until frictional engagement of the edges 62 and 64 occur respectively with the channels 82 and 87 due to taper of the channels 80 and the continued movement of the container section 70 in the direction of the arrow 110. A reversed view of the frictional engagement of the fixture 55 and the associated container section 70 is seen best in FIG. 4.

Similarly, the righthand container section of FIG. 2, is positioned inwardly of the associated fixtures 55 and is moved to the right as shown by arrow 115 until frictional engagement occurs. When both container sections 70 have been positioned properly, the display unit 50 is ready to receive the merchandise 105 as best illustrated in FIG. 1. Because the edges 76 and 77 of the flat side walls 71 of each container section 70 slant downwardly at an angle of about 10° to 12° from a line normal to the apertured board 100 front surface, the merchandise 105 stored within each container section continually is urged by gravity toward the end flanges or panels 72, thereby to provide constant feed of merchandise to the customer. In order to provide a stable unit 50, it is necessary to use four fixtures 55 to construct the display unit with one fixture near the top and bottom of each rear wall 74, thereby ensuring rigidity of the entire display unit. This construction results in a boxed or rigid corner rather than a flexible corner which is important, since prior art units tend to be flimsy and easily spread, thereby spilling the merchandise and requiring additional time to restack the goods.

While there has been illustrated a display unit 50 for use with paint rollers 105 and the like, it will be understood that the display unit can accommodate elongated goods of most of any type; however, cylindrical goods are best displayed with the unit of the present invention. Presently, there has been described what now is considered to be the preferred embodiment of the present invention, but it will be understood that various modifications and alterations may be made therein without departing from the true spirit and scope of the present invention and it is intended to cover in the appended claims all such alterations and modifications.

What is claimed is:

1. A display unit used with an apertured support for displaying a plurality of elongated objects, comprising a plurality of fixtures each having a body portion which in use has top and bottom edges, at least two engagement prongs extending outwardly from said fixture body and which in use extend through apertures in the support to mount the fixture thereto, a spacer extending outwardly from said fixture for maintaining said fixture a predetermined distance from the support surface, each of said engagement prongs and said spacer extending away from said fixture at junctures spaced inwardly from the top and bottom edges of said body, a pair of container sections with each section being mountable on at least one fixture, mounting means on the rear of each container section forming opposed channels for engaging each associated fixture to mount said container section to said fixture and to the support surface, said engagement prongs and said spacer being located inwardly from the top and bottom edge of said fixture body a distance sufficient to permit sliding engagement of said mounting means and said fixture body, said container sections when mounted on said fixtures and the support surface combining to form side, end and bottom walls for retaining and displaying a plurality of elongated objects.

2. A display unit as set forth in claim 1, wherein each of said fixtures has two engagement prongs with each prong having one section thereof extending away from said fixture body beyond said outwardly extending spacer and another section thereof extending at substantially right angles to the one section.

3. A display unit as set forth in claim 2, wherein each of said fixtures has two spacer prongs integrally formed from the fixture body extending outwardly therefrom to maintain said fixtures a predetermined distance from the associated support, thereby to permit said mounting means to fit between said fixture and the support.

4. A display unit as set forth in claim 1, wherein the top and bottom edges of each fixture are parallel.

5. A display unit as set forth in claim 1, wherein each container section has two mounting means thereon, one positioned near the container section top and one near the container section bottom.

6. A display unit as set forth in claim 1, wherein the longitudinal axis of the display unit mounted on the associated support is downwardly sloping from the support at an angle of about 10° to about 12° from a line normal to the plane of the support, and the container sections are transparent.

7. A display unit as set forth in claim 1, wherein each container section has a rear wall having mounting means extending rearwardly therefrom forming two channels, each channel being formed by spaced apart lips constructed and arranged to fit between the associated fixture body and the support surface to mount the container section to the support.

8. A display unit used with an apertured support for displaying a plurality of elongated objects, comprising a plurality of fixtures each having a body portion which in use has top and bottom edges, engagement prongs connected to and extending outwardly from each of said fixture bodies and which in use extends through apertures in the support to mount said fixture thereto, a spacer connected to and extending outwardly from each of said fixture bodies in the same direction as said prongs for maintaining said fixture a predetermined distance from the support surface, each of said engagement prongs and said spacer extending away from said fixture at junctures spaced inwardly from the top and bottom edges of said fixture body, a pair of container sections with each section being mountable on at least one fixture, mounting means on the rear of each container section extending rearwardly therefrom and forming two opposed channels, each channel being formed by spaced apart lips constructed and arranged to fit between the associated fixture body and the support surface to mount the container section to the support, each channel being tapered such that the channel at one end thereof is wider than the vertical extent of the associated fixture body and at the other end thereof is narrower than the associated fixture body to permit frictional engagement of each channel and the associated fixture body to provide a rigid mounting of said container sections and fixtures to the support surface, said container sections when mounted on said fixtures and the support surface combining to form side, end and bottom walls for retaining and displaying a plurality of elongated objects.

9. A display unit as set forth in claim 8, wherein each container section has a vertically disposed front wall.

10. A one piece fixture for mounting to an apertured support surface, comprising a body in use having top, bottom and side edges and having a spacer extending outwardly therefrom to maintain the fixture body a predetermined distance from the apertured support, spaced apart engagement prongs extending outwardly from said body, separately from said spacer, with each of said engagement prongs having one section thereof extending away from said fixture body beyond said outwardly extending spacer and another section thereof extending at substantially right angles to said one section, said engagement prongs and and said spacer being integral with said fixture body and formed therefrom, the juncture between said spacer and said fixture body and the junctures between said engagement prongs and said fixture body being positioned inwardly with respect to the top, bottom and side edges of said fixture body to thereby space the fixture body from the support surface when the fixture is mounted on said support surface.

* * * * *